US006118352A

United States Patent [19]

Wendel

[11] Patent Number: 6,118,352

[45] Date of Patent: Sep. 12, 2000

[54] MICROWAVE COMPONENT COMPRISING GYROMAGNETIC MATERIAL EXPOSED TO ADJUSTABLE MAGNETIC FIELD STRENGTH

[75] Inventor: Ralf Wendel, Pinneberg, Germany

[73] Assignee: U.S. Philips Corporation, New York, N.Y.

[21] Appl. No.: 09/026,450

[22] Filed: Feb. 19, 1998

[30] Foreign Application Priority Data

Feb. 22, 1997 [DE] Germany ..... 197 07 153

[51] Int. Cl.[7] ..... H01P 1/32

[52] U.S. Cl. ..... 333/24.1; 333/1.1; 333/24.2

[58] Field of Search ..... 333/1.1, 24.1–24.3, 333/158, 205, 209, 211, 219.2, 232, 207, 223, 226, 235

[56] References Cited

U.S. PATENT DOCUMENTS

| | | | |
|---|---|---|---|
| 3,085,212 | 4/1963 | Clark et al. | 333/1.1 |
| 3,090,930 | 5/1963 | Dunn | 333/24.1 |
| 3,311,839 | 3/1967 | Rutulis | 333/232 X |
| 3,448,409 | 6/1969 | Moose et al. | 333/1.1 |
| 4,376,923 | 3/1983 | Curtinot et al. | 333/232 |
| 4,613,838 | 9/1986 | Wada et al. | 333/226 X |
| 4,636,756 | 1/1987 | Ito et al. | 333/205 |

FOREIGN PATENT DOCUMENTS

| | | | |
|---|---|---|---|
| 130991 | 1/1949 | Australia | 333/226 |
| 56-85919 | 7/1981 | Japan | 333/1.1 |

*Primary Examiner*—Paul Gensler
*Attorney, Agent, or Firm*—Gregory L. Thorne

[57] ABSTRACT

A description is given of a microwave component which includes a microwave conductor arrangement for conducting electromagnetic waves and a gyromagnetic material which is provided in operative contact with the electromagnetic waves and can be subjected to a magnetic field of adjustable field strength in that the gyromagnetic material, at least one magnet for generating the magnetic field, and a magnetic tuning member, whose magnetic conductivity can be varied in order to adjust the magnetic field strength, are arranged in a magnetic circuit.

2 Claims, 1 Drawing Sheet

MICROWAVE COMPONENT COMPRISING GYROMAGNETIC MATERIAL EXPOSED TO ADJUSTABLE MAGNETIC FIELD STRENGTH

BACKGROUND OF THE INVENTION

The invention relates to a microwave component which includes a microwave conductor arrangement for conducting electromagnetic waves and a gyromagnetic material which is provided in operative contact with the electromagnetic waves.

Particularly non-reciprocal multi-port microwave components such as circulators or isolators are constructed in this way. Because of their physical operating principle these components necessarily contain gyromagnetic materials, notably ferrite materials, which are exposed to a magnetic field of defined field strength. In order to form this magnetic field, a permanent magnet can be provided in the microwave component in such a manner that its magnetic field extends through the gyromagnetic material. In order to adjust an optimum function of the microwave component, it will usually be necessary to adjust the magnetic field strength to an accurately defined value. The magnetic field strength can be adjusted by magnetizing the magnet to full saturation. Subsequently, its magnetization is step-wise reduced until the desired magnetic field strength value is obtained for which an optimum function of the desired kind can be measured on the microwave component.

However, it has been found that when this approach is used, it often occurs that the magnetic field is attenuated too much during demagnetization. The described procedure must then be completely repeated, i.e. the magnet must again be saturated and subsequently demagnetized again. Such an adjusting procedure is very intricate and expensive, notably in the case of bulk manufacture.

It is an object of the invention to construct a microwave component of the kind set forth in such a manner that the adjustment of the magnetic field strength is simplified.

SUMMARY OF THE INVENTION

The object according to the invention is achieved by a microwave component which includes a microwave conductor arrangement for conducting electromagnetic waves and a gyromagnetic material which is provided in operative contact with the electromagnetic waves and can be exposed to a magnetic field of adjustable field strength in that the gyromagnetic material, at least one magnet for forming the magnetic field, and a magnetic tuning member, having a magnetic conductivity which can be varied so as to adjust the magnetic field strength, are arranged in a magnetic circuit.

The adjustment of the magnetic field strength in such a microwave component is performed by a magnetic tuning member which is included in the magnetic circuit. The magnet for forming the magnetic field can then be inserted and operated, without modification, in the state in which it is delivered for the manufacture of the microwave component. Preferably, the magnet is magnetized to saturation. The adjustment of the magnetic field strength in the microwave component does not affect the magnet; the magnetic field strength now being adjusted by increasing or decreasing the magnetic conductivity of the magnetic tuning member.

An attractive embodiment of the microwave component according to the invention is characterized in that it includes a housing which at least partly encloses the microwave conductor arrangement, the gyromagnetic material and the magnet, is made at least partly of a magnetically conductive material, is arranged in the magnetic circuit, and constitutes at least a part of the magnetic tuning member by way of one of its parts situated in the magnetic circuit.

This construction of the magnetic tuning member enables adjustment of the magnetic field strength also in the fully assembled condition of the microwave component. and also enables a magnetic tuning member to be obtained without additional components or at least with few additional components.

Preferably, the magnetic tuning member includes a part which can be geometrically modified in order to adjust the magnetic field strength. Adjustment can then be performed by mechanical influencing of the magnetic tuning member, thus ensuring that the characteristics of, for example the magnet or the gyromagnetic material, are not modified.

Preferably, the magnetic tuning member comprises an air gap of variable width. This air gap of variable width is notably provided between two parts of the magnetic circuit whose geometrical position relative to one another is adjustable and at least one of which is formed by a part of the housing. The air gap of variable width can thus be provided, for example between a part of the housing and the magnet, but also between two parts of the housing. The air gap of the magnetic tuning member can notably be formed while using an adjustable screw, an adjustable pin, discs that can be inserted as desired and/or a mechanically deformable strip. The adjustable screw or the adjustable pin is then preferably connected to a part of the housing, the air gap of variable width then being formed directly between this screw or pin and the magnet. The mechanically deformable strip can be formed from a part of the housing which is situated within the magnetic circuit, for example by punching. The discs that can be inserted as desired can be connected to a part of the housing, thus varying their distance, for example with respect to the magnet.

The geometrically deformable part in a further embodiment of the invention is formed by a part of the housing whose wall thickness can be varied and is situated in the magnetic circuit. The relationship between the wall thickness and the magnetic conductivity is then used for adjustment.

BRIEF DESCRIPTION OF THE DRAWING

Some embodiments of the invention are shown in the drawing and win be described in detail hereinafter.

DESCRIPTION OF THE PREFERRED EMBODIMENTS

Figure 1:
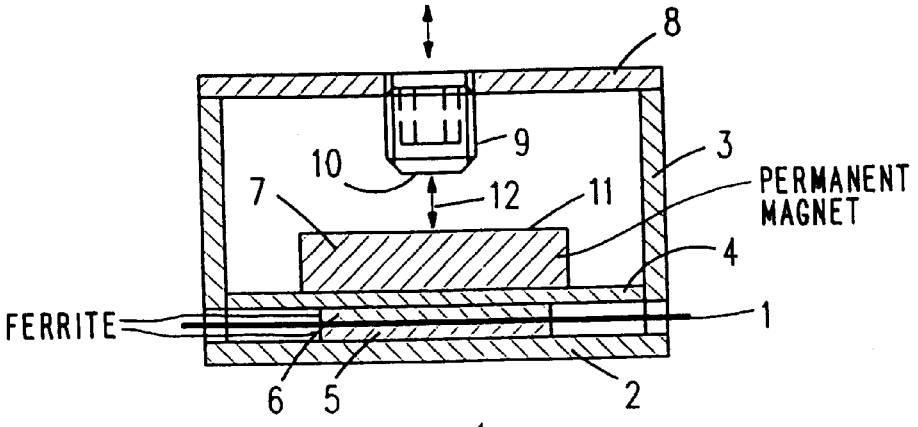
FIG. 1 shows a first embodiment of a microwave component according to the invention which includes a magnetic tuning member in the form of a screw.

FIG. 1 shows a microwave component which comprises a microwave conductor arrangement which consists of an inner conductor 1, a bottom portion 2 of a substantially pot-shaped housing 3, and an outer conductor 4 inserted into the housing 3. The inner conductor 1 extends essentially in one plane; the bottom portion 2 and the outer conductor 4 extend parallel to this plane. Between the inner conductor 1 and the bottom portion 2 of the housing 3 there is provided a first element which consists of a gyromagnetic material, preferably a disc of a ferrite material. This ferrite disc is denoted by the reference numeral 5. A second ferrite disc 6, having the same construction, is arranged between the inner conductor 1 and the outer conductor 4. The microwave conductor arrangement 1, 2, 4 constitutes, in conjunction with the ferrite discs 5, 6, a non-reciprocal multi-port microwave component, for example a circulator or an isolator, and has a construction which is known per se.

In order to expose the ferrite discs 5, 6 to a magnetic field of defined strength which extends perpendicularly to the direction of propagation of the electromagnetic waves conducted along the planar dimension of the inner conductor 1 in the microwave conductor arrangement 1, 2, 4, a permanent magnet 7 is arranged flat on the outer conductor 4. The permanent magnet 7 is included in a magnetic circuit which comprises, in addition to the permanent magnet 7, the ferrite discs 5, 6, the housing 3 including its bottom portion 2, as well as a lid 8 whereby the housing 3 is closed at its side which is remote from the bottom portion 2. To this end, the housing 3 and the lid 8 are made of a magnetically conductive material, preferably steel. A magnetic tuning member is provided in the form of a magnetically conductive screw 9 which is screwed into a threaded hole in the lid 8. Between an end face 10 of the screw 9 and the facing surface 11 of the permanent magnet 7, also being arranged parallel to the plane in which the inner conductor 1 extends in the embodiment shown, there is situated an air gap 12 whose width, i.e. the distance between the end face 10 and the surface 11, can be varied by turning the screw 9. The permanent magnet is magnetized to saturation. The magnetic field strength in the ferrite discs 5, 6 is adjusted by turning the screw 9. The magnetic field strength can thus be simply adjusted in the assembled condition of the microwave component, without the magnetic properties of the permanent magnet itself being modified. When comparatively large values are adjusted in respect of the width of the air gap, it is usually advisable to use a permanent magnet having a high magnetic field strength. Such permanent magnets are preferably made of hard ferrite as well as of alloys such as NeFeB and SmCo.

Instead of using a screw 9, a mechanical adjustment of this kind can also be performed by means of a magnetically conductive pin which can be more simply manufactured and takes the place of the screw 9 in the arrangement shown in FIG. 1. The air gap 12 could also be adjusted to the required width by repeatedly bonding magnetically conductive discs to the bottom of the lid 8, instead of using the screw 9, or to the surface 11 of the permanent magnet 7.

Like for the microwave conductor arrangement 1, 2, 4 shown, the invention can also be advantageously used for microwave conductor arrangements of different construction, for example for hollow conductor circulators and the like. In any case, a simple, inexpensive and exact possibility for adjustment of the magnetic field strength is created.

Figure 2:
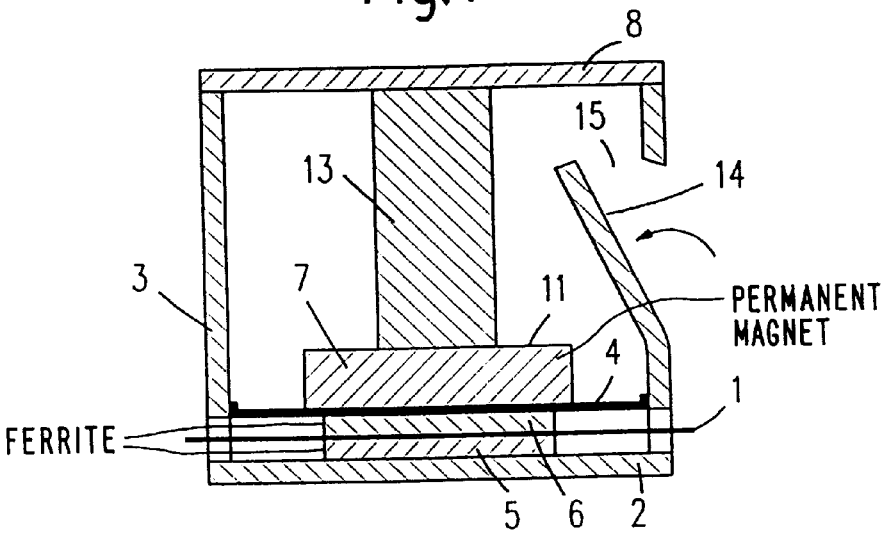
FIG. 2 shows a second embodiment which includes a tuning member in the form of a mechanically deformable strip.

In the embodiment shown in FIG. 2, in which the elements corresponding to FIG. 1 are denoted by corresponding reference numerals, a magnetically conductive element 13, for example made of steel, is arranged between the lid 8 and the surface 11 of the permanent magnet 7, instead of the screw 9, in order to close the magnetic circuit. Instead of the screw 9 of FIG. 1, replaced by said element 13, a mechanically deformable strip 14 is used as the magnetic tuning member in FIG. 2. The strip 14 is formed from a wall of the housing 3, for example by punching. An air gap 15 of variable width is formed between the strip 14 and the remainder of the housing 3 by bending the strip 14. The adjustment of the magnetic field strength in the ferrite discs 5, 6 is performed by deliberate deformation, i.e. by accurately defined bending of the strip 14 inside the housing 3. Again, the magnetic properties of the permanent magnet 7 are not affected thereby.

Figure 3:
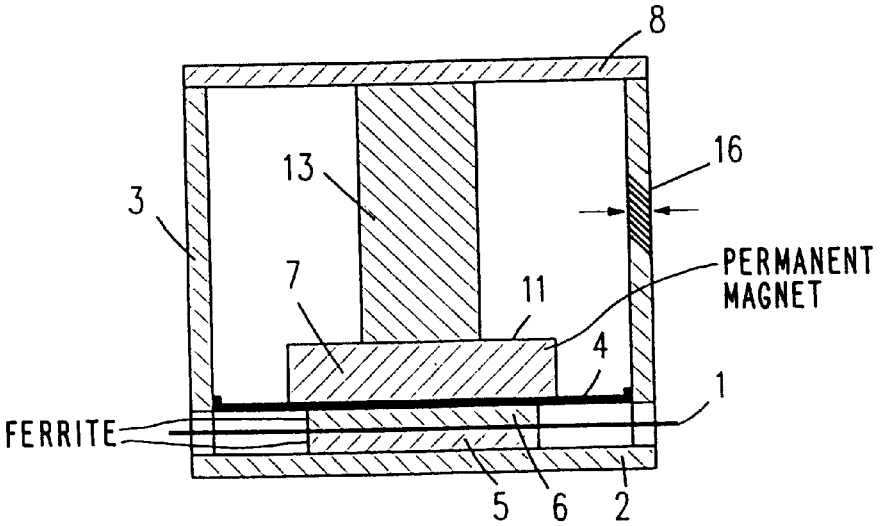
FIG. 3 shows a third embodiment which includes a tuning member in the form of a part of the housing whose wall thickness can be varied.

FIG. 3 shows a third embodiment in which the strip 14 of FIG. 2 is replaced by a predetermined portion 16 of the wall of the housing 3 which is mechanically deformed for example by applying a compressing force to either side of portion 16 so as to change its wall thickness. This is denoted by a denser hashing in the area of deformation and arrows. The portion 16 in FIG. 3 thus constitutes the magnetic tuning member whose magnetic conductivity varies as a function of the wall thickness and hence is used to adjust the magnetic field strength.

Again, the permanent magnet 7 as such is not affected by the adjustment of the magnetic field strength in the embodiment shown in FIG. 3.

The magnetic tuning member in the embodiments shown in the FIGS. 2 and 3 can be constructed in a particularly simple manner since it requires no additional components and no or only very little additional work which, however, is insignificant considering the savings achieved by the simplification of the adjusting operation.

What is claimed is:

1. A microwave component which includes a microwave conductor arrangement for conducting electromagnetic waves and a gyromagnetic material which is provided in operative contact with the electromagnetic waves and can be exposed to a magnetic field of adjustable field strength in the gyromagnetic material, at least one magnet for forming the magnetic field, and a magnetic tuning member, having a magnetic conductivity which can be varied so as to adjust the magnetic field strength, are arranged in a magnetic circuit, and a portion of the magnetic tuning member is formed by a part of a housing whose wall thickness can be varied to adjust the magnetic field strength.

2. A microwave component which includes a microwave conductor arrangement for conducting electromagnetic waves and a gyromagnetic material which is provided in operative contact with the electromagnetic waves and can be exposed to a magnetic field of adjustable field strength in the gyromagnetic material, at least one magnet for forming the magnetic field, and a magnetic tuning member, having a magnetic conductivity which can be varied so as to adjust the magnetic field strength, are arranged in a magnetic circuit, and a portion of the magnetic tuning member is formed by a part of a housing having a deformable strip that can be deformed to adjust the magnetic field strength.

* * * * *